US011819741B2

(12) United States Patent
Oldknow et al.

(10) Patent No.: US 11,819,741 B2
(45) Date of Patent: Nov. 21, 2023

(54) GOLF CLUB HEAD AND GOLF CLUB HEAD STRUCTURES

(71) Applicant: KARSTEN MANUFACTURING CORPORATION, Phoenix, AZ (US)

(72) Inventors: Andrew G. V. Oldknow, Beaverton, OR (US); James S. Thomas, Madisonville, LA (US); Hiroshi Kawaguchi, Aliso Viejo, CA (US); Robert Boyd, Double Oak, TX (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 16/896,093

(22) Filed: Jun. 8, 2020

(65) Prior Publication Data

US 2020/0298074 A1 Sep. 24, 2020

Related U.S. Application Data

(63) Continuation of application No. 15/971,837, filed on May 4, 2018, now Pat. No. 10,675,515, which is a (Continued)

(51) Int. Cl.
*A63B 53/06* (2015.01)
*A63B 60/02* (2015.01)
(Continued)

(52) U.S. Cl.
CPC ..... *A63B 53/0466* (2013.01); *A63B 53/06* (2013.01); *A63B 60/02* (2015.10);
(Continued)

(58) Field of Classification Search
CPC . A63B 53/0466; A63B 53/06; A63B 53/0433; A63B 2053/0491; A63B 60/52;
(Continued)

(56) References Cited

U.S. PATENT DOCUMENTS 1,133,129 A * 3/1915 Govan ..... A63B 53/047 473/337
3,556,533 A * 1/1971 Hollis ..... A63B 60/00 473/338
(Continued)

FOREIGN PATENT DOCUMENTS

CN 1089875 A 7/1994
GB 303290 A * 1/1929 ..... A63B 53/08
(Continued)

OTHER PUBLICATIONS

International Written Opinion and Search Report, dated Dec. 22, 2011 in PCT Appl. No. PCT/US2011/051758.
(Continued)

*Primary Examiner* — John E Simms, Jr.

(57) ABSTRACT

Golf clubs and golf club heads having a weight member that is configurable in multiple positions to alter the performance characteristics of the golf club head are presented. In some examples, the weight member may be arranged in a sole of the golf club head and may include ends having different weighting characteristics. For instance, one end may be heavier or denser than another end of the weight member. The difference in weight characteristics may be due to different materials used to form the different ends, different construction of the ends, and the like. The position of the weight member may be adjusted to alter the performance characteristics of the golf club head. For instance, the weight member may be removed and rotated to position a heavier end where a lighter end was previously positioned.

9 Claims, 17 Drawing Sheets

Related U.S. Application Data continuation of application No. 15/040,633, filed on Feb. 10, 2016, now Pat. No. 9,987,533, which is a continuation of application No. 13/592,606, filed on Aug. 23, 2012, now Pat. No. 9,440,126, which is a continuation-in-part of application No. 12/894,390, filed on Sep. 30, 2010, now Pat. No. 8,425,348.

(60) Provisional application No. 61/526,327, filed on Aug. 23, 2011.

(51) Int. Cl.
*A63B 60/04* (2015.01)
*A63B 53/04* (2015.01)
*A63B 60/52* (2015.01)

(52) U.S. Cl.
CPC ..... *A63B 60/04* (2015.10); *A63B 53/0433* (2020.08); *A63B 60/52* (2015.10); *A63B 2053/0491* (2013.01); *A63B 2209/00* (2013.01)

(58) Field of Classification Search
CPC ..... A63B 2209/00; A63B 53/10; A63B 60/02; A63B 60/04
See application file for complete search history.

(56) References Cited

U.S. PATENT DOCUMENTS

| | | | | |
|---|---|---|---|---|
| 3,979,122 | A | 9/1976 | Belmont | |
| 3,979,123 | A | 9/1976 | Belmont | |
| 4,085,934 | A * | 4/1978 | Churchward | A63B 53/0466 473/338 |
| 4,607,846 | A | 8/1986 | Perkins | |
| 4,869,507 | A | 9/1989 | Sahm | |
| 5,916,042 | A * | 6/1999 | Reimers | A63B 53/04 473/345 |
| 6,089,994 | A | 7/2000 | Sun | |
| 6,123,627 | A * | 9/2000 | Antonious | A63B 60/00 473/328 |
| 6,277,032 | B1 | 8/2001 | Smith | |
| 6,773,360 | B2 * | 8/2004 | Willett | A63B 53/0466 473/334 |
| 7,108,609 | B2 * | 9/2006 | Stites | A63B 53/06 473/256 |
| 7,147,573 | B2 | 12/2006 | DiMarco | |
| 7,153,220 | B2 * | 12/2006 | Lo | A63B 53/0466 473/335 |
| 7,223,180 | B2 * | 5/2007 | Willett | A63B 53/0466 473/334 |
| 7,351,163 | B2 * | 4/2008 | Shimazaki | A63B 53/0466 473/345 |
| 7,407,447 | B2 * | 8/2008 | Beach | A63B 60/02 473/324 |
| 7,611,424 | B2 | 11/2009 | Nagai et al. | |
| 7,824,280 | B2 * | 11/2010 | Yokota | A63B 60/02 473/334 |
| 7,988,568 | B2 * | 8/2011 | Stites | A63B 60/02 473/334 |
| 8,337,319 | B2 | 12/2012 | Sargent et al. | |
| 8,425,348 | B2 | 4/2013 | Boyd et al. | |
| 8,591,352 | B2 | 11/2013 | Hirano | |
| 8,690,707 | B2 | 4/2014 | Stites et al. | |
| 9,700,764 | B2 | 7/2017 | Carter | |
| 2002/0165041 | A1 * | 11/2002 | Takeda | A63B 60/02 473/349 |
| 2003/0139226 | A1 | 7/2003 | Cheng et al. | |
| 2005/0148406 | A1 * | 7/2005 | Mahaffey | A63B 60/02 473/345 |
| 2006/0105856 | A1 * | 5/2006 | Lo | A63B 60/00 473/334 |
| 2006/0122004 | A1 * | 6/2006 | Chen | A63B 53/0466 473/335 |
| 2007/0049400 | A1 * | 3/2007 | Imamoto | A63B 60/02 473/345 |
| 2009/0118034 | A1 * | 5/2009 | Yokota | A63B 60/00 473/338 |
| 2009/0186717 | A1 * | 7/2009 | Stites | A63B 60/02 473/291 |
| 2009/0203465 | A1 * | 8/2009 | Stites | A63B 53/0466 473/343 |
| 2010/0160091 | A1 * | 6/2010 | Boyd | A63B 53/0466 473/409 |
| 2010/0222155 | A1 * | 9/2010 | Jones | A63B 53/0487 473/341 |
| 2010/0331103 | A1 * | 12/2010 | Takahashi | A63B 53/0466 473/338 |
| 2011/0009209 | A1 * | 1/2011 | Llewellyn | A63B 53/04 473/336 |

FOREIGN PATENT DOCUMENTS

| | | | | |
|---|---|---|---|---|
| JP | 3259136 | | 11/1999 | |
| JP | 2006505367 | A | 2/2006 | |
| JP | 2006141710 | A | 8/2006 | |
| JP | 2006-320493 | * | 11/2006 | |
| JP | 2006320493 | A * | 11/2006 | |
| JP | 2006320493 | A | 11/2006 | |
| JP | 2010530782 | A | 9/2010 | |
| JP | 2009112570 | A | 11/2010 | |
| JP | 2011125623 | | 6/2011 | |
| KR | 20060023226 | * | 3/2006 | A63B 53/04 |

OTHER PUBLICATIONS

International Written Opinion and Search Report, dated Feb. 21, 2013, in PCT Appl. No. PCT/US2012/052050.

* cited by examiner

GOLF CLUB HEAD AND GOLF CLUB HEAD STRUCTURES

CROSS-REFERENCE TO RELATED APPLICATIONS

This is a continuation of U.S. patent application Ser. No. 15/971,837 filed on May 4, 2018, which is a continuation of U.S. patent application Ser. No. 15/040,633 filed on Feb. 10, 2016, which is a continuation of U.S. patent application Ser. No. 13/592,606 filed on Aug. 23, 2012, now U.S. Pat. No. 9,440,126 issued on Sep. 13, 2016, which claims the benefit of U.S. Provisional Patent Application No. 61/526,327 filed on Aug. 23, 2011 and is a continuation-in-part of U.S. patent application Ser. No. 12/894,390 filed on Sep. 30, 2010, now U.S. Pat. No. 8,425,348 issued on Apr. 23, 2013. These applications are hereby incorporated by reference in their entirety.

TECHNICAL FIELD

Aspects of this invention relate generally to golf clubs and golf club heads, and, in particular, to golf clubs and golf club heads having an adjustable weight that may be arranged in multiple positions to alter the performance characteristics of the golf club.

BACKGROUND

Golfers tend to be sensitive to the "feel" of a golf club. The "feel" of a golf club comprises the combination of various component parts of the club and various features associated with the club that produce the sensations experienced by the player when a ball is swung at and/or struck. Club weight, weight distribution, swing weight, aerodynamics, swing speed, and the like all may affect the "feel" of the club as it swings and strikes a ball. "Feel" also has been found to be related to the sound produced when a club head strikes a ball to send the ball in motion. If a club head makes an unpleasant, undesirable, or surprising sound at impact, a user may flinch, give up on his/her swing, decelerate the swing, lose his/her grip, and/or not completely follow-through on the swing, thereby affecting distance, direction, and/or other performance aspects of the swing and the resulting ball motion. User anticipation of this unpleasant, undesirable, or surprising sound can affect a swing even before the ball is hit.

The performance of a golf club can vary based on several factors, including weight distribution about the head, which affects the location of the center of gravity of the golf club head. When the center of gravity is positioned behind the point of engagement on the contact surface, the golf ball follows a generally straight route. When the center of gravity is spaced to a side of the point of engagement, however, the golf ball may fly in an unintended direction and/or may follow a route that curves left or right, including ball flights that often are referred to as "pulls," "pushes," "draws," "fades," "hooks," or "slices." Similarly, when the center of gravity is spaced above or below the point of engagement, the flight of the golf ball may exhibit more boring or climbing trajectories, respectively.

Altering the moment of inertia can also affect how the golf club performs including how the golf club head design impacts heel and toe mishits. Similarly, other factors such as point of impact and launch angle can also affect how the ball travels once it has been struck.

Weight distribution can further impact golf ball trajectory by providing a change in ball spin. The distance and direction of ball flight can be significantly affected by the spin imparted to the ball by the impact with the club head. Additionally, the spin of the ball can change the behavior of the ball as it rolls and bounces after impact with the ground.

Club designers are often looking for new ways to redistribute weight associated with a golf club and/or golf club head. For instance, club designers are often looking to distribute weight to provide more forgiveness in a club head, improved accuracy, better spin control, or to provide a particular golf ball trajectory and the like. Accordingly, it would be advantageous to provide a golf club head having increased weighting configurations or improved distribution of weight throughout the club head.

SUMMARY

At least some aspects of the disclosure relate to golf clubs and golf club heads having a weight member that is configurable in multiple positions to alter the performance characteristics of the golf club head. For instance, the weight member may be arranged in a sole of the golf club head and may include ends having different weighting characteristics. For instance, one end may be heavier or denser than another end of the weight member. The difference in weight characteristics may be due to different materials used to form the different ends, different construction of the ends, and the like. The position of the weight member may be adjusted to alter the performance characteristics of the golf club head. For instance, the weight member may be removed and rotated to position a heavier end where a lighter end was previously positioned.

These and additional features and advantages disclosed here will be further understood from the following detailed disclosure of certain embodiments.

Figure 1A:
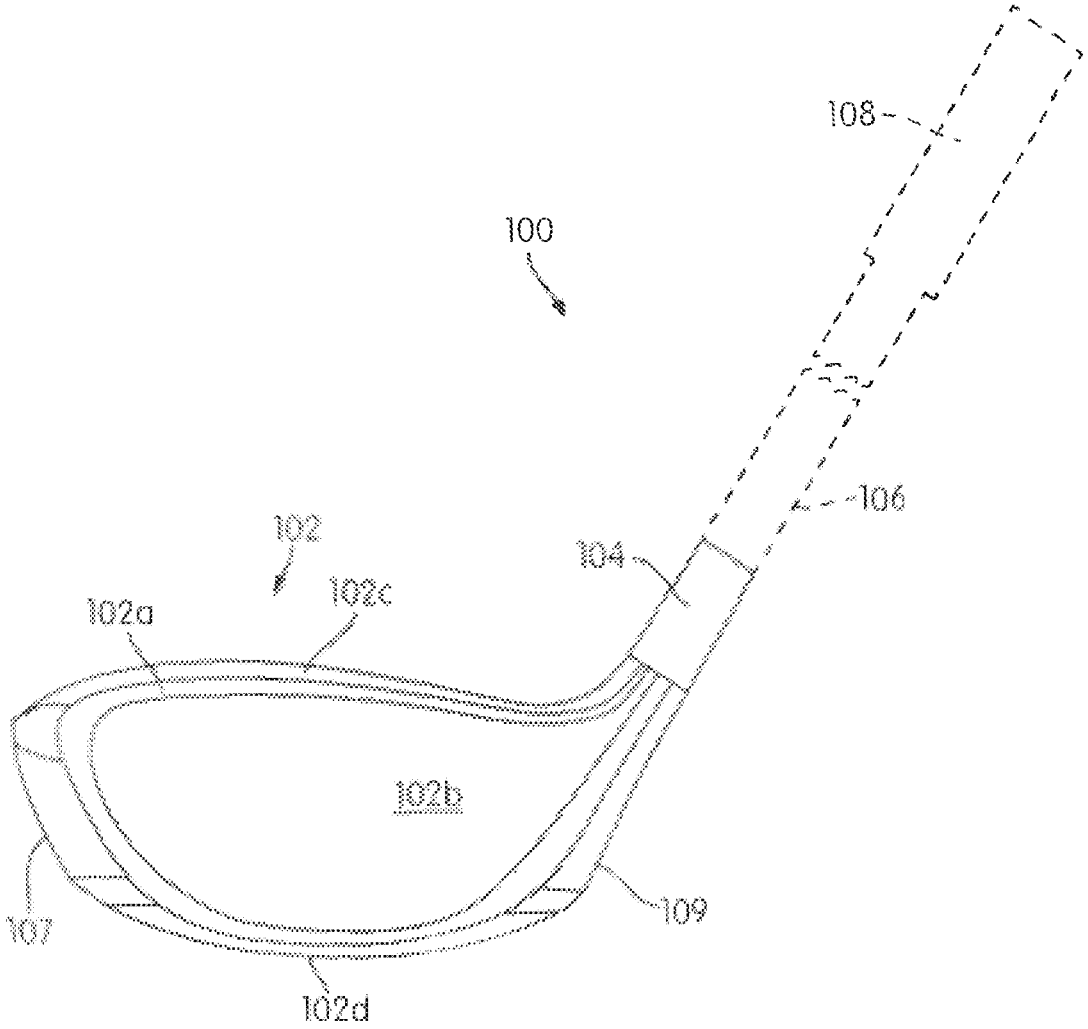
FIGS. 1A and 1B illustrate example golf club and golf club head structures according to one or more aspects described herein.

The figures referred to above are not drawn necessarily to scale, should be understood to provide a representation of particular embodiments of the invention, and are merely conceptual in nature and illustrative of the principles involved. Some features of the golf club and golf club head structures depicted in the drawings have been enlarged or distorted relative to others to facilitate explanation and understanding. The same reference numbers are used in the drawings for similar or identical components and features shown in various alternative embodiments. Golf clubs and golf club head structures as described herein may have configurations and components determined, in part, by the intended application and environment in which they are used.

DETAILED DESCRIPTION

In the following description of various example structures in accordance with the invention, reference is made to the accompanying drawings, which form a part hereof, and in which are shown by way of illustration various example articles, including one or more golf club or golf club head structures. Additionally, it is to be understood that other specific arrangements of parts and structures may be utilized and structural and functional modifications may be made without departing from the scope of the present invention. Also, while the terms "top," "bottom," "front," "back," "rear," "side," "underside," "overhead," and the like may be used in this specification to describe various example features and elements of the invention, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of this invention. Further, the invention generally will be described as it relates to wood-type golf clubs. However, aspects of the invention may be used with any of several types of golf clubs, including hybrid type golf clubs, utility clubs, and the like and nothing in the specification or figures should be construed to limit the invention to use with the wood-type golf clubs described.

A. General Description of an Illustrative Golf Club with Golf Club Head Having an Adjustable Weight In general, as described above, aspects of this invention relate to a golf club or golf club head structure. More detailed descriptions of aspects of this invention follow.

1. Example Golf Clubs and Golf Club Heads Having Adjustable Weights

Aspects of this invention relate to golf club and golf club head structures. In at least some examples, a golf club head body has a front, a rear, a top, a sole, a toe and a heel An adjustable weighted member extends in a front to rear direction along the sole of the golf club head body. The adjustable weighted member has a first end having a first weight and a second end having a second weight different from the first weight. The adjustable weighted member is removable from the golf club head to adjust a position of the first end and the second end.

In at least some other examples, a golf club head body has a front, a rear, a top, a sole, a toe and a heel. A recess is formed in the sole of the club head body and extends in a front to rear direction along the sole of the golf club head body. An adjustable weighted member is configured to be received in the recess. The adjustable weighted member has a first end having a first weight and a second end having a second weight different from the first weight. The adjustable weighted member is removable from the golf club head to adjust a position of the first end and the second end Additional aspects and specific examples of the articles described above will be described in detail more fully below. The reader should understand that these specific examples are set forth merely to illustrate examples of the invention, and they should not be construed as limiting the invention.

B. Specific Examples of the Invention

Figure 1B:
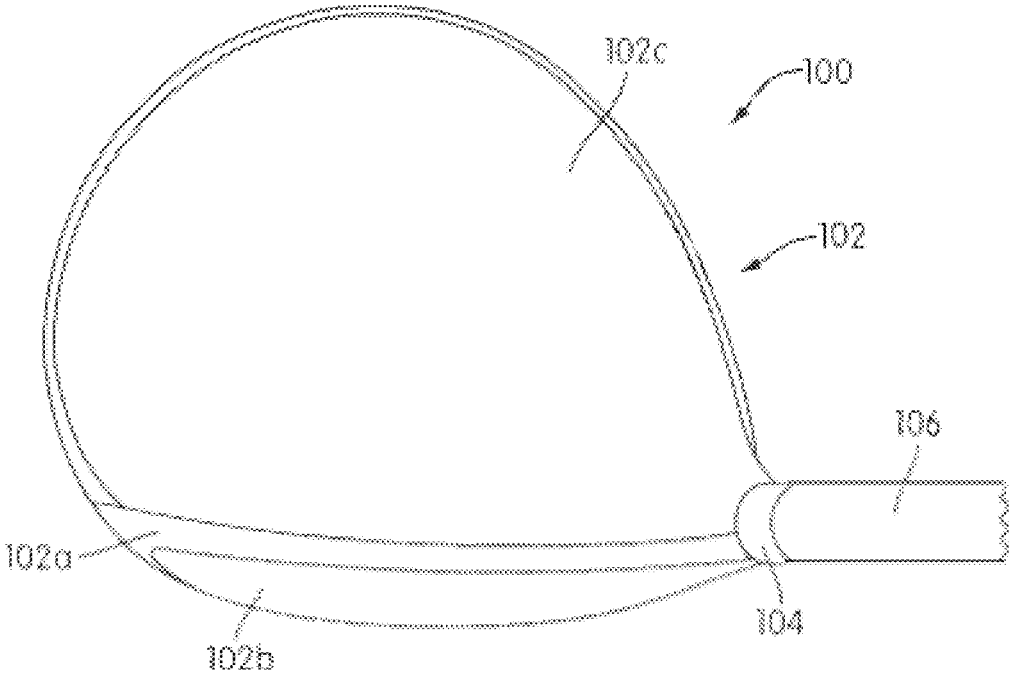

FIGS. 1A and 1B generally illustrate an example golf club 100 and/or golf club head 102 in accordance with this invention. In addition to the golf club head 102, the overall golf club structure 100 of this example includes a hosel 104, a shaft 106 received in and/or inserted into and/or through the hosel 104, and a grip or handle 108 attached to the shaft 106. Optionally, if desired, the external hosel 104 may be eliminated and the shaft 106 may be directly inserted into and/or otherwise attached to the head 102 (e.g., through an opening provided in the top of the club head 102, through an internal hosel (e.g., provided within an interior chamber defined by the club head 102), etc.).

The shaft 106 may be received in, engaged with, and/or attached to the club head 102 in any suitable or desired manner, including in conventional manners known and used in the art, without departing from the invention. As more specific examples, the shaft 106 may be engaged with the club head 102 via a hosel 104 and/or directly to the club head structure 102, e.g., via adhesives, cements, welding, soldering, mechanical connectors (such as threads, retaining elements, or the like), etc.; through a shaft-receiving sleeve or element extending into the club head body 102; etc. The shaft 106 also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle 108 may be attached to, engaged with, and/or extend from the shaft 106 in any suitable or desired manner, including in conventional manners known and used in the art, e.g., using adhesives or cements; via welding, soldering, adhesives, or the like; via mechanical connectors (such as threads, retaining elements, etc.); etc. As another example, if desired, the grip or handle 108 may be integrally formed as a unitary, one-piece construction with the shaft 106. Additionally, any desired grip or handle 108 materials may be used without departing from this invention, including, for example: rubber materials, leather materials, rubber or other materials including cord or other fabric material embedded therein, polymeric materials, and the like.

The club head 102 itself also may be constructed in any suitable or desired manner and/or from any suitable or desired materials without departing from this invention, including from conventional materials and/or in conventional manners known and used in the art. For example, in the example club head 102 shown in FIG. 1, the club head 102 includes a front face 102*a* that generally includes a ball striking surface 102*b* (optionally including a ball striking face plate integrally formed with the ball striking surface 102*a* or attached to the club head such that the face plate and a frame together constitute the overall ball striking surface 102*a*). The club head 102 may further include a top or crown 102*c*, a sole 102*d*, a toe 107 and a heel 109. The club head 102 may also include a rear (not shown in FIG. 1).

A wide variety of overall club head constructions are possible without departing from this invention. For example, if desired, some or all of the various individual parts of the club head 102 described above may be made from multiple pieces that are connected together (e.g., by welding, adhesives, or other fusing techniques; by mechanical connectors; etc.). The various parts (e.g., crown, sole, front face, rear, etc.) may be made from any desired materials and combinations of different materials, including materials that are conventionally known and used in the art, such as metal materials, including lightweight metal materials, and the like. More specific examples of suitable lightweight metal materials include steel, titanium and titanium alloys, aluminum and aluminum alloys, magnesium and magnesium alloys, etc. Additionally or alternatively, the various parts of the club head may be formed of one or more composite materials. The club head 102 also may be made by forging, casting, or other desired processes, including club head forming processes as are conventionally known and used in the art.

The various individual parts that make up a club head structure 102, if made from multiple pieces, may be engaged with one another and/or held together in any suitable or desired manner, including in conventional manners known and used in the art. For example, the various parts of the club head structure 102, such as the front face 102*a*, ball striking surface 102*b*, the top 102*c*, the sole 102*d*, etc., may be joined and/or fixed together (directly or indirectly through intermediate members) by adhesives, cements, welding, soldering, or other bonding or finishing techniques; by mechanical connectors (such as threads, screws, nuts, bolts, or other connectors); and the like. If desired, the mating edges of various parts of the club head structure 102 may include one or more raised ribs, tabs, ledges, or other engagement elements that fit into or onto corresponding grooves, slots, surfaces, ledges, openings, or other structures provided in or on the facing side edge to which it is joined. Cements, adhesives, mechanical connectors, finishing material, or the like may be used in combination with the raised rib/groove/ledge/edge or other connecting structures described above to further help secure the various parts of the club head structure 102 together.

The dimensions and/or other characteristics of a golf club head structure according to examples of this invention may vary significantly without departing from the invention, and the dimensions may be consistent with those commonly used in the art for similar club heads and clubs.

Figure 2A:
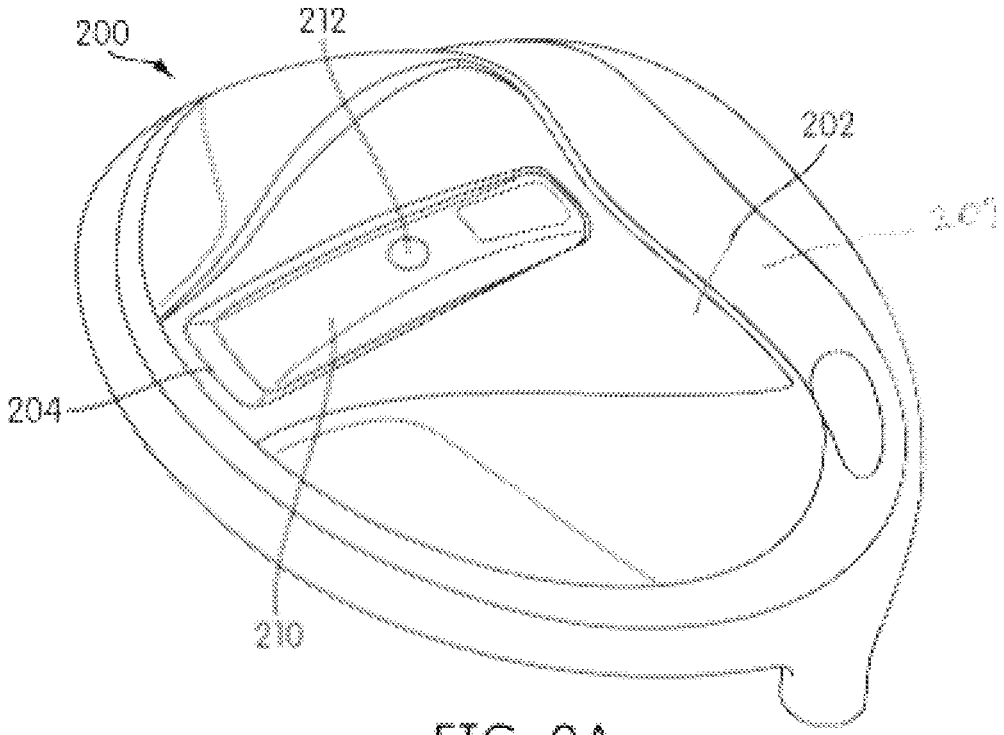
FIGS. 2A-2C illustrate an example golf club head having an adjustable weight member arranged in the sole of the golf club head according to one or more aspects described herein.
Figure 2B:
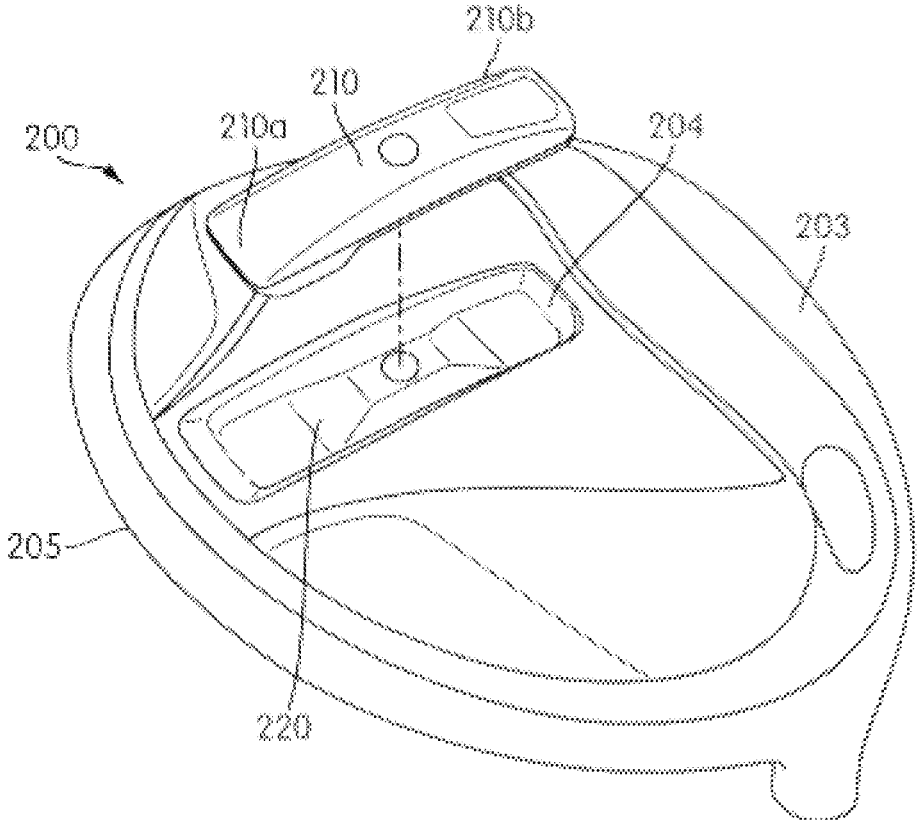
Figure 2C:
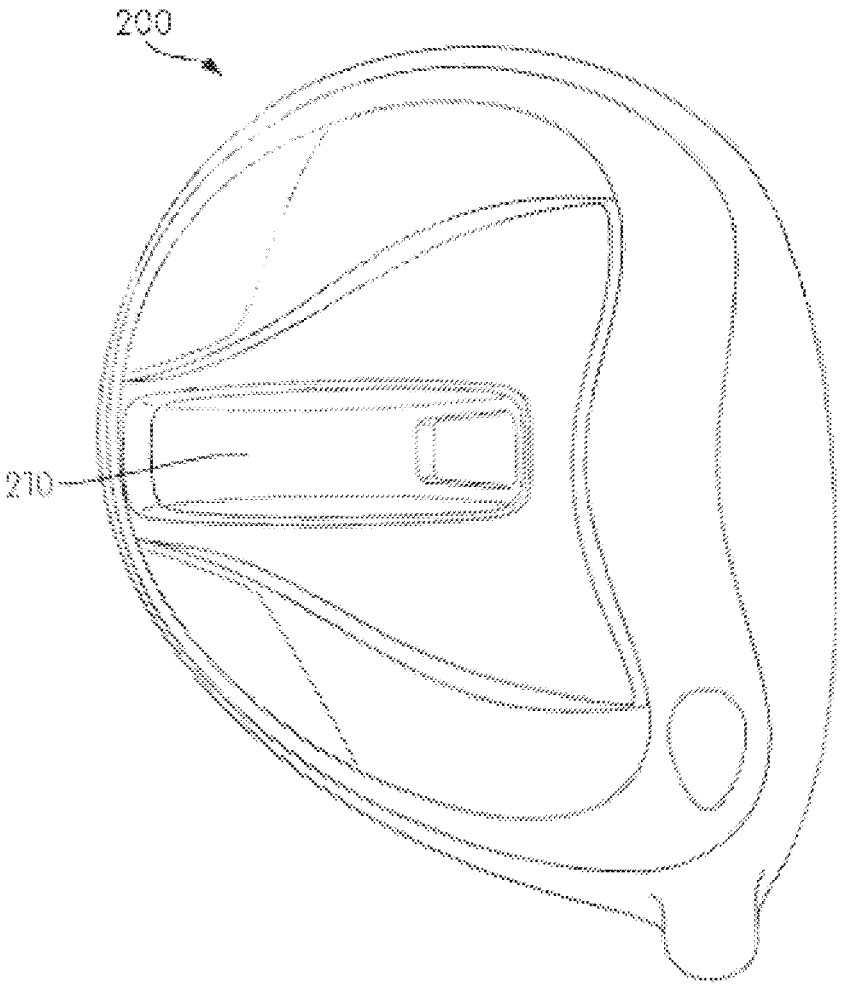

FIGS. 2A-2C illustrate one example golf club head having an adjustable weight member that is configurable in multiple positions to alter the performance characteristics of the golf club head. FIG. 2A is a bottom perspective view of the golf club head 200. The bottom or sole 202 includes a recess 204 configured to receive an adjustable weight member 210. The recess 204 may extend in a front 203 to rear 205 direction. The recess 204 may be generally rectangular and have a major longitudinal axis and a minor lateral axis. The major longitudinal axis is generally transverse to the ball striking face of the club head in an exemplary embodiment. The lateral axis extends in a heel to toe direction on the club head. The adjustable weight member 210 may be positioned in the recess 204 and, in some examples, be connected to the golf club head 200 via a screw or other fastener extending through aperture 212. It is also noted that the club head may have a channel 207 extending across the sole of the club head 200 from a heel to a toe and generally adjacent the ball striking face. The channel allows a certain amount of compression of the club head upon ball impact. This feature may cooperate with the other club head structures and weighting characteristics to further enhance performance of the club.

The weight member 210 may be connected to the golf club head 200 in the recess 204 via a mating connection portion 220. The mating connection portion may have a shape corresponding to the shape of the weight member 210 in order to aid in aligning the weight member 210 and maintaining the position of the weight member 210. As shown in FIG. 2B, the mating connection portion 220 may define a raised portion wherein the aperture to receive the fastener is generally centrally located in the raised portion. It is understood that the weight member 210 may have a corresponding cut-out portion to accommodate and receive the mating connection portion 220 when the weight member is fastened to the golf club head as can be appreciated from FIG. 2A. The cut-out portion removes weight from a central portion of the weight member 210 whereby weight can be more focused at the ends of the weight member 210. As discussed above, the weight member 210 may be connected to the golf club head 200 via a fastener, such as a screw, extending through aperture 212 and into the mating connecting portion 220. As can be appreciated from FIG. 2A, the weight member 210 is dimensioned such that the weight member 210 is generally flush with the overall sole surface of the club head 200 when received in the recess 204.

As desired, the position of the weight member 210 may be adjusted by removing the fastener, removing the weight member 210 and "flipping" it around, such that the first end 210*a* is proximal the front 203 of the golf club head and the second end 210*b* is proximal the rear 205 of the golf club head. Once the desired position of the weight member 210 is achieved, the fastener may be inserted and tightened to maintain the position of the weight member.

The weight member 210 may include different weight characteristics along a length of the weight member 210. For instance, the weight member 210 may include two ends 210*a* and 210*b* having different weight characteristics. In some examples, the two ends 210*a* and 210*b* may be formed of different materials (either formed as a single piece of two different materials or formed separately from different materials and joined). In some examples, one material may be heavier, denser, etc. than a second material. Thus, each end 210*a*, 210*b* of the weight member 210 may have different weight characteristics (e.g., one end may be heavier than the other). This allows for distribution of weight associated with the golf club head 200 as desired.

Additionally or alternatively, the two ends may be constructed differently, in order to provide different weight characteristics at each end 210*a*, 210*b* of the weight member 210. For instance, as shown in FIG. 2B, one end of the weight member 210*a*, may be thicker than another end 210*b* in order to provide additional weight. Additionally or alternatively, one end 210*b* may have a hollow construction or an aperture formed therein in order to reduce the weight of that end 210*b* relative to an opposite end 210*a* of the weight member 210.

Figure 3A:
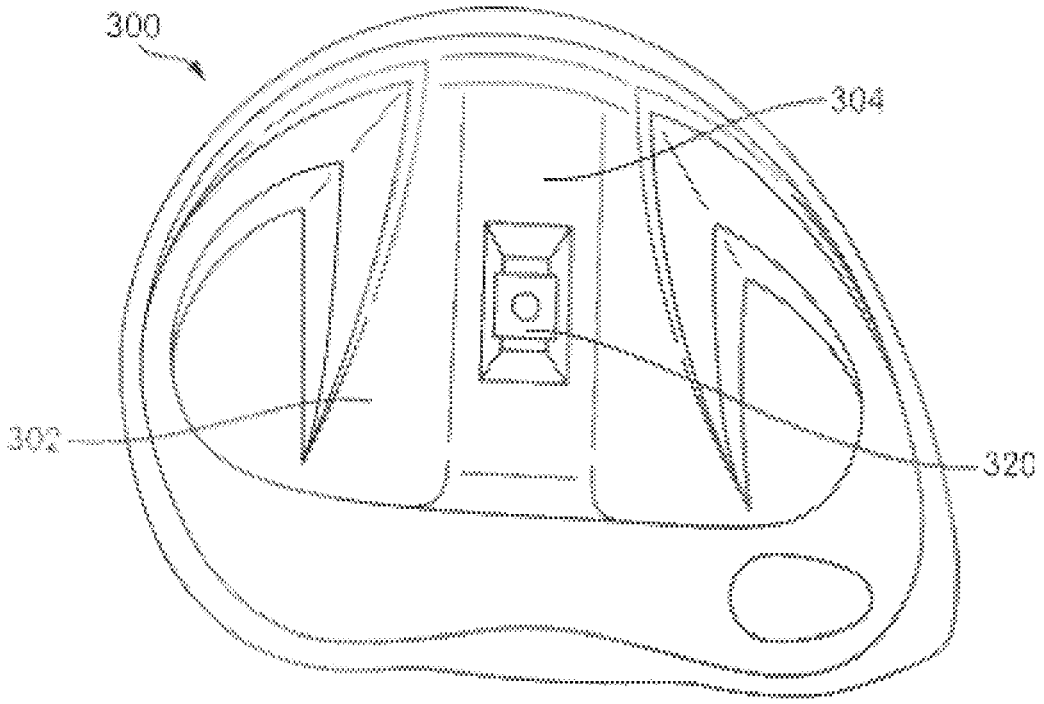
FIGS. 3A-3C illustrate another example golf club head having an adjustable weight member according to one or more aspects described herein.
Figure 3B:
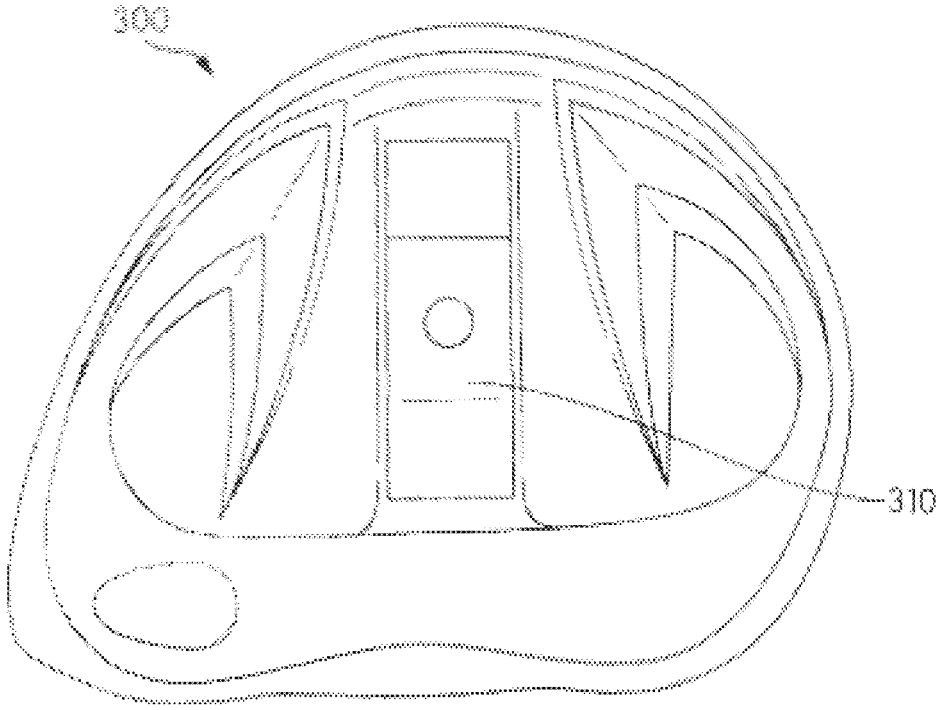
Figure 3C:
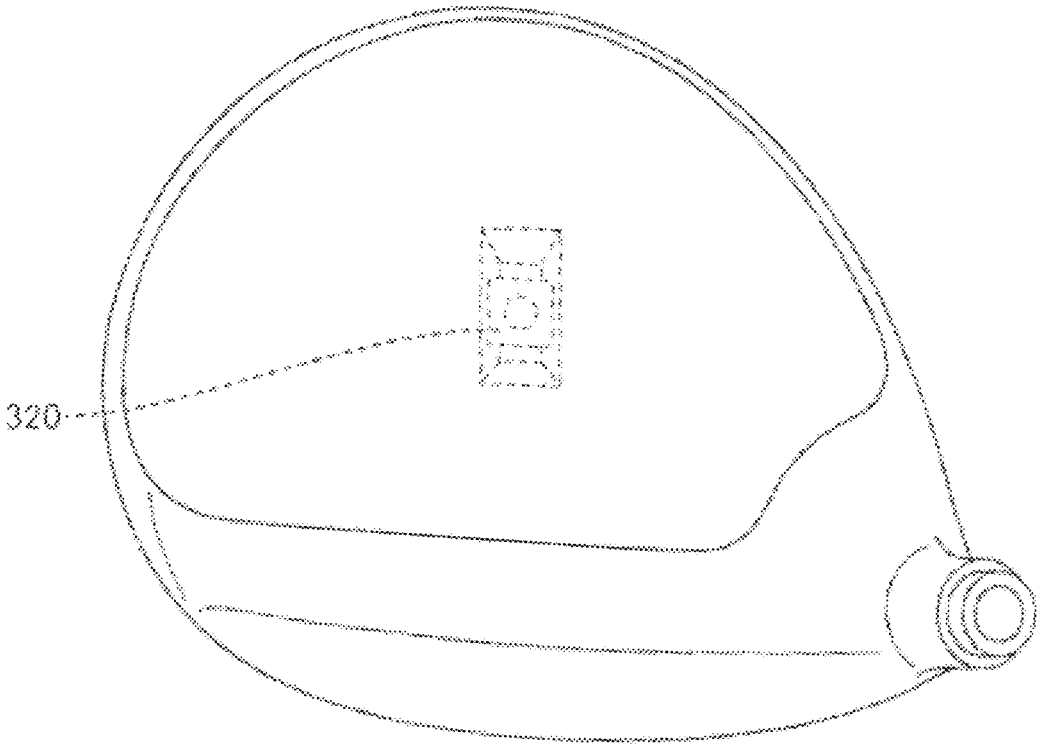

FIGS. 3A-3C illustrate another golf club head having an adjustable weight arrangement according to one or more aspects described herein. Similar to the arrangement described above, the sole 302 of the golf club head 300 includes a recess 304 having a mating connection portion 320 arranged therein. The weighted member 310 may be positioned in the recess 304 to correspond to the mating connection portion 320 which aids in alignment of the weight member and positioning of the weight member 310. The weighted member 310 may then be connected to the golf club head 300 via a screw or other fastener extending between the weight member 310 and the mating connection portion 320. The club head 300 may also have a channel along the sole as described above.

As shown in FIG. 3C, the mating connection portion 320 may be arranged within the golf club head 300 such that it is not visible from a top of the golf club head 300.

Figure 4:
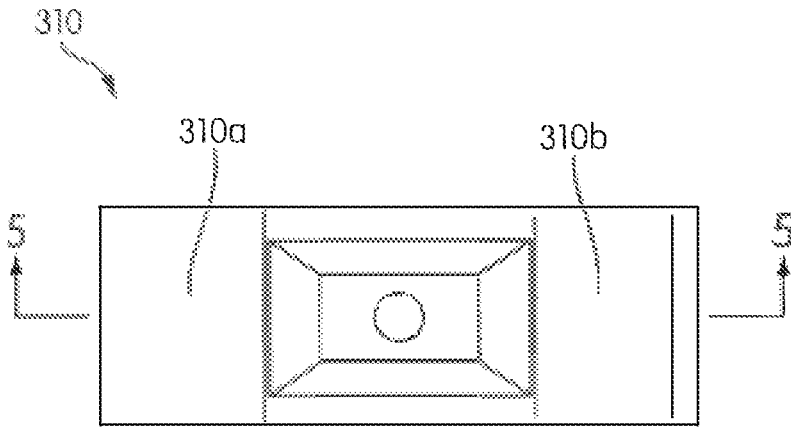
FIG. 4 is a top view of an adjustable weight member according to one or more aspects described herein.
Figure 5:
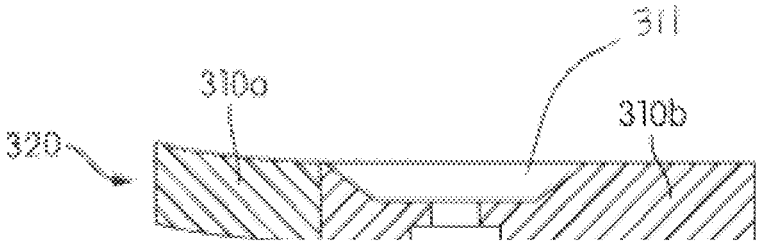
FIG. 5 is a cross sectional view of the adjustable weight member of FIG. 4 taken along line 5-5 according to one or more aspects described herein.

FIG. 4 is an enlarged, close-up view of the weighted member 310 of FIGS. 3A-3C. FIG. 5 is a cross section of the weighted member 310 taking along line 5-5 in FIG. 4. Although in the arrangements discussed above, the weighted member is rectangular, various other shapes may be used without departing from the invention, as will be discussed below. In the arrangement shown, the weighted member 310 is generally rectangular having a major longitudinal axis and a minor longitudinal axis generally corresponding to the recess provided in the club head. Further in the arrangement shown, one end 310*a* may be heavier, denser, etc. than an opposite end 310*b*. As discussed above, the ends may be formed of different materials or have different construction in order to provide the different weight characteristics. In some examples, one end (e.g., 310*b*) may be formed of the same material as a central, connecting portion of the weighted member 310, while the other end 310*a* is formed of a different material (e.g., a heavier material). The difference in weight of the ends 310*a*, 310*b* of the weight member 310 may allow a user to position the weighted member to provide desired performance characteristics of the golf club head 300. That is, if a user desires to move the center of gravity of a golf club head toward the rear of the golf club head 300, he or she may position the weighted member 310 with the heavier end proximal the rear of the golf club head 300. As further shown in FIGS. 4 and 5, the weight member 310 has a cut-out portion 311 that receives the mating connecting portion 320. Notwithstanding the cut-out portion, the underside surface of the weight member 310 is generally planar. In particular, the underside surface is generally planar at the respective ends 310*a*, 310*b* wherein the weights are concentrated. There is an absence of any depending structures at the ends 310, 310*b*.

The weighted member 310 and the ends 310*a*, 310*b* of the member 310 may be formed of any suitable materials. For instance, the heavier end may be formed of steel or other heavy metal, while the lighter end may be formed of lightweight metals, such as aluminum, titanium, etc., metal alloys, composite materials, plastics, and the like. As discussed above, the weighted member 310 may be formed as a single piece with the two ends 310*a*, 310*b* being formed of different materials or denser/less dense forms of the same material (e.g., in a two shot process). Additionally or alternatively, the weighted member 310 may be formed in one or more pieces that are joined using known methods, such as snap fits, mechanical fasteners, adhesives, welding, and the like.

Figure 6A:
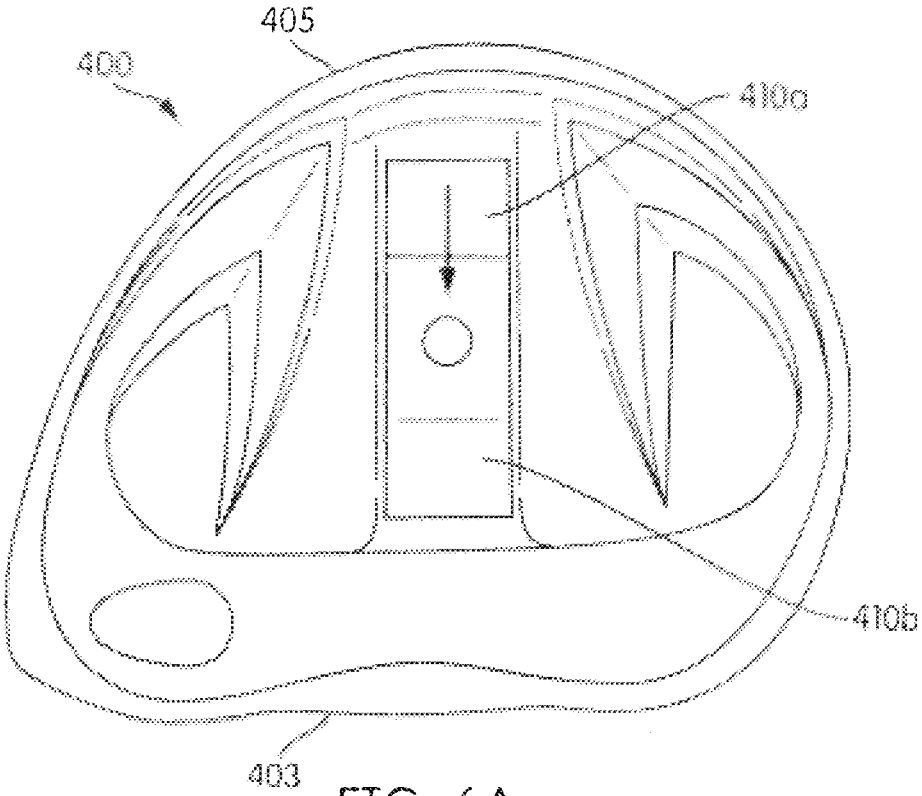
FIGS. 6A and 6B illustrate another golf club head having an adjustable weight member and illustrating the weight in multiple positions according to one or more aspects described herein.
Figure 6B:
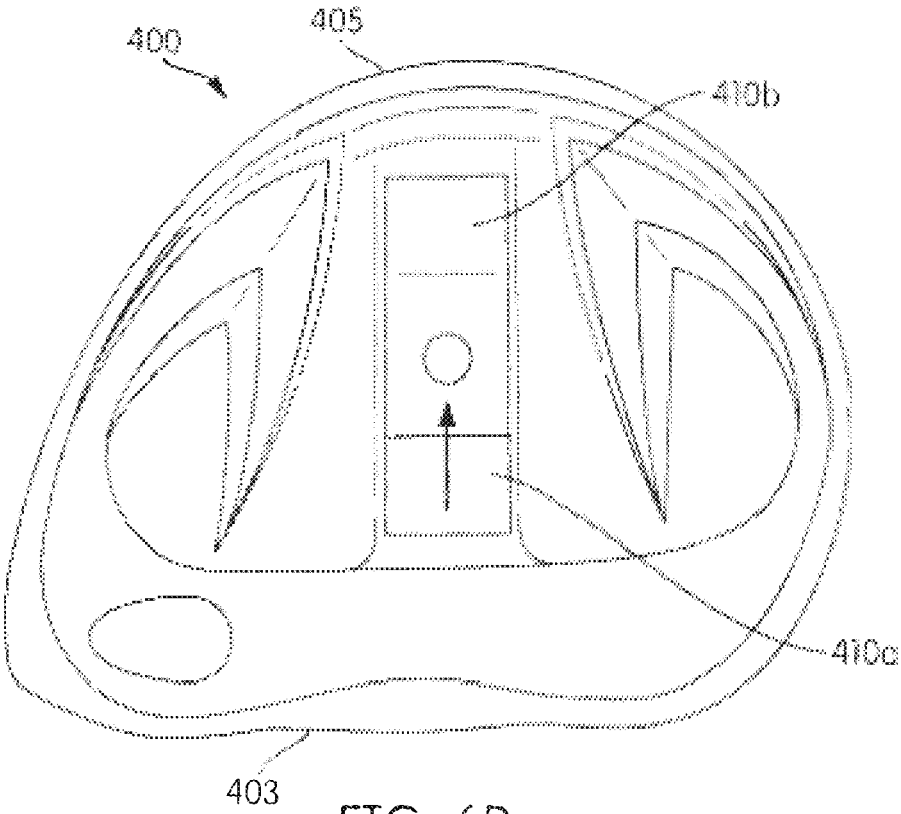

FIGS. 6A and 6B illustrate the adjustable nature of the weighted member according to at least some aspects described herein. The golf club head 400 includes a weighted member 410 similar to those discussed above. As discussed above, one end, a first end 410*a*, may have a greater weight then an opposite end 410*b*. This may be due to different materials being used to form the ends 410*a*, 410*b*, different construction of the ends 410*a*, 410*b*, etc. In FIG. 6A, the heavier end 410*a* is positioned proximal the rear 405 of the golf club head while the lighter end 410*b* is proximal the front 403 of the golf club head. In FIG. 6B, the weight member 410 has been reversed and the heavier end 410*a* is proximal the front 403 of the golf club head while the lighter end 410*b* is proximal the rear 405 of the golf club head.

Figure 7A:
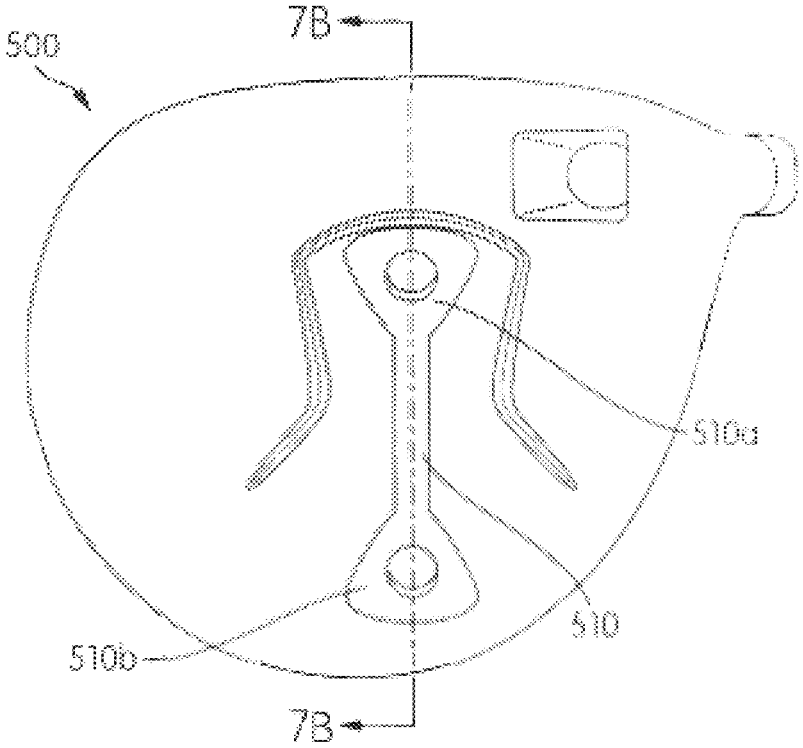
FIG. 7A is another golf club head arrangement having an adjustable weight member according to one or more aspects described herein.
Figure 7B:
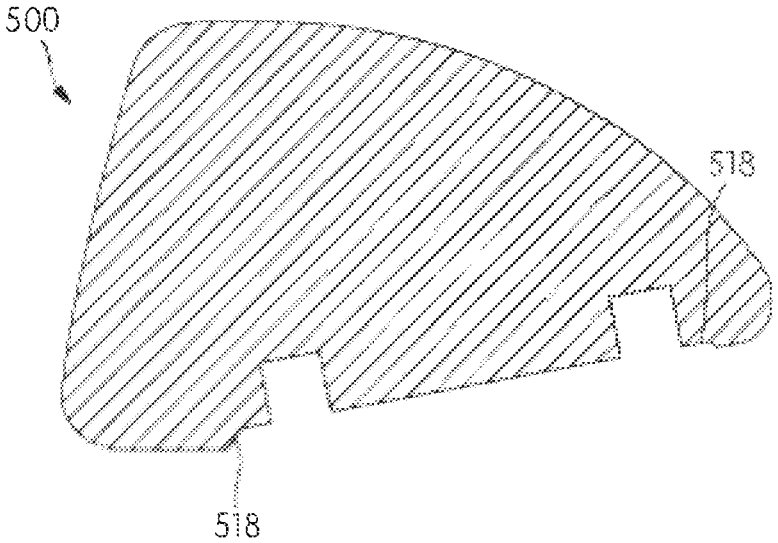
FIG. 7B is a cross sectional view of the golf club head of FIG. 7A taken along line A-A according to one or more aspects described herein.

FIGS. 7A and 7B illustrate golf club head 500 having an alternative weighted member arrangement according to one or more aspects described herein. FIG. 7B is a cross section of the golf club head 500 of FIG. 7A taken along line 7B-7B. As shown in FIG. 7A, the weighted member has a slender center portion joining the two ends 510*a* and 510*b*. As the slender center portion defines a reduced width, more weight can be focused on the ends of the weighted member to maximize the effect of the weighted member on the performance characteristics of the club head. Similar to the arrangements discussed above, the ends 510*a* and 510*b* may have different weight characteristics and the weight member 510 may be adjustable to position the weight member 510 in a position to provide desired performance characteristics of the golf club head 500.

In the arrangement shown, the weighted member 510 may be connected to the golf club head 500 at two points, one at each end. The weight member 510 may be connected to the golf club head using screws or other fasteners.

Further, as shown in FIG. 7B, the weighted member 510 is positioned within a recess in the sole of the golf club head 510. Notches 518 provide a sufficient recess for the weighted member 510 to protect the member from debris, wear, etc. during use of the golf club. Further, the recess may aid in preventing the weighted member 510 from protruding outward from the sole of the golf club head and/or becoming loose due to contact with the ground, etc.

The upward incline of the sole of the golf club head 510 further aids in adjusting the weight of the golf club head. For instance, positioning the heavier end of the weighted member nearer the front of the club may shift the center of gravity down, toward the sole. On the other hand, positioning the heavier end of the weighted member nearer the rear of the club may shift the center of gravity back, toward the rear.

Figure 8:
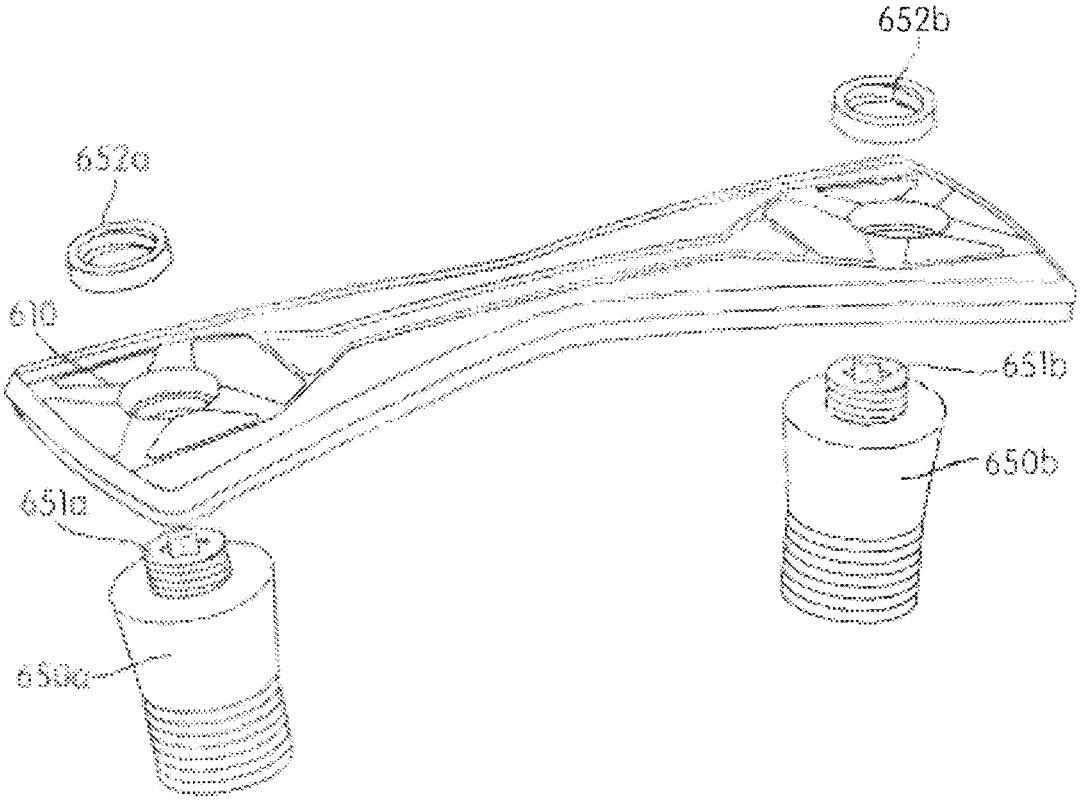
FIG. 8 is an exploded view of an adjustable weighted member and a plurality of fasteners that may be used to connect the weighted member to a golf club head according to one or more aspects described herein.

FIG. 8 is an exploded view of one weighted member fastening arrangement according to one or more aspects described herein. The weighted member 610 includes two fastening points, similar to the arrangement shown in FIG. 7A. In some examples, the weighted member 610 may be connected to the golf club head via one or more threaded fasteners. As shown in FIG. 8, a portion of the threaded fastener 650*a*, 650*b* is threaded, and may be inserted into the golf club head. A second portion of the threaded fastener 650*a*, 650*b*, may be smooth. The threaded fastener 650*a*, 650*b* may include a threaded protrusion 651*a*, 651*b* that extends through the aperture in the weighted member 610 and connects to a nut 652*a*, 652*b* on the opposite side of the weighted member 610 to secure the weighted member 610 to the golf club head.

As discussed above, the weighted member 610 may have different weight properties at each end of the weighted member 610 (e.g., one end may be heavier or denser than an opposite end). The weighted member 610 may then be connected to the golf club head with the desired weight properties in the desired position in order to adjust the performance characteristics of the golf club head. It is further understood that the threaded fasteners 650*a*, 650*b* may also possess different weighting characteristics as desired.

Figure 9:
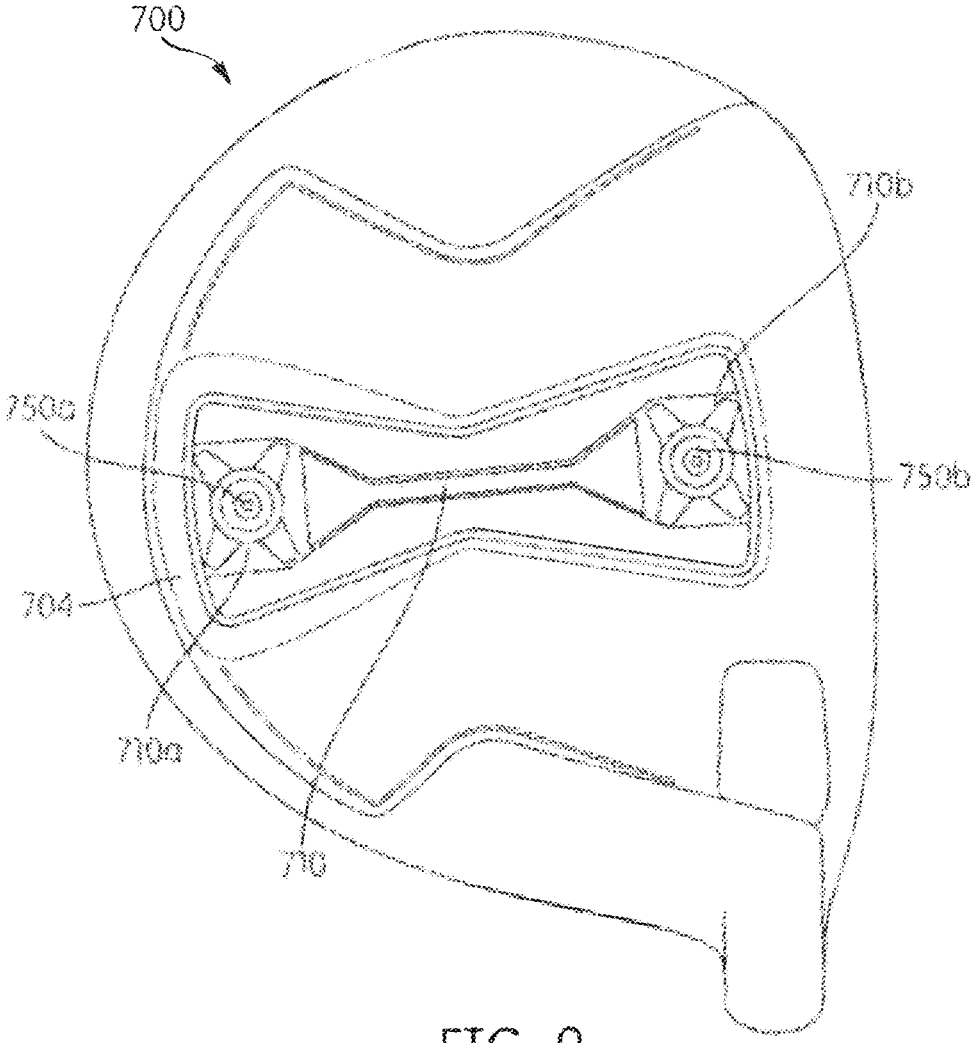
FIG. 9 illustrates another golf club head arrangement having an adjustable weighted member according to one or more aspects described herein.

FIG. 9 is a bottom view of a golf club head 700, similar to the golf club head 500 of FIGS. 7A and 7B. The weighted member 710, as shown, is connected to the golf club head at two points. In some arrangements, the weighted member 710 may be connected to the golf club head 700 using threaded fasteners 752*a*, 752*b*. Similar to the arrangements discussed above, the weighted member 710 may be positioned in a recess 704 formed in the sole of the golf club head 700 to prevent wear and to aid in maintaining the position of the weighted member 710.

End 710*a* has a slightly different appearance from end 710*b* that may indicate the end 710*a* has different weight characteristics than end 710*b*. For instance, end 710*a* may be formed of a different material than end 710*b*, thereby making it heavier or lighter than end 710*b*. Additionally or alternatively, the construction of end 710*a* may be different from that of 710*b* (e.g., 710*a* may be hollow while 710*b* is solid, vice versa). The difference in appearance between ends 710*a* and 710*b* may aid in determining a desired position of the weighted member 710. For instance, a user may easily identify the heavier or lighter end based on the different in appearance and can connect the weighted member 710 to the golf club head 700 with the weighted member 710 in the desired orientation based on the appearance. The difference in appearance may be provided by different materials being used or may be provided during manufacture, and may include different colors, shapes, sizes, thicknesses, and the like.

Figure 10:
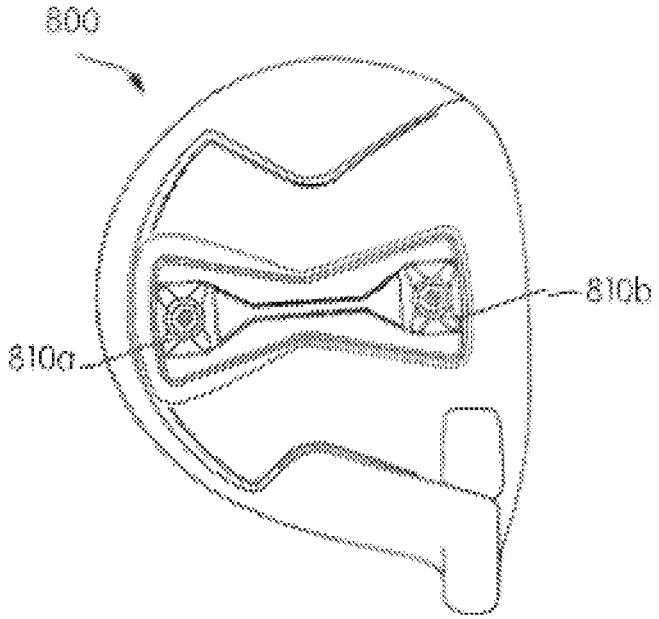
FIG. 10 is yet another golf club head arrangement having an adjustable weighted member according to one or more aspects described herein.

Alternatively, in some arrangements, the ends 710*a*, 710*b* may have a substantially similar or substantially identical appearance such that the ends may look the same while having different weight characteristics. For instance, the golf club head 800 of FIG. 10 includes a weighted member 810 in which ends 810*a*, 810*b* have a substantially similar appearance. Despite the substantially similar appearance of the ends 810*a*, 810*b*, the ends 810*a*, 810*b* may have different weight characteristics, as discussed above.

Figure 11A:
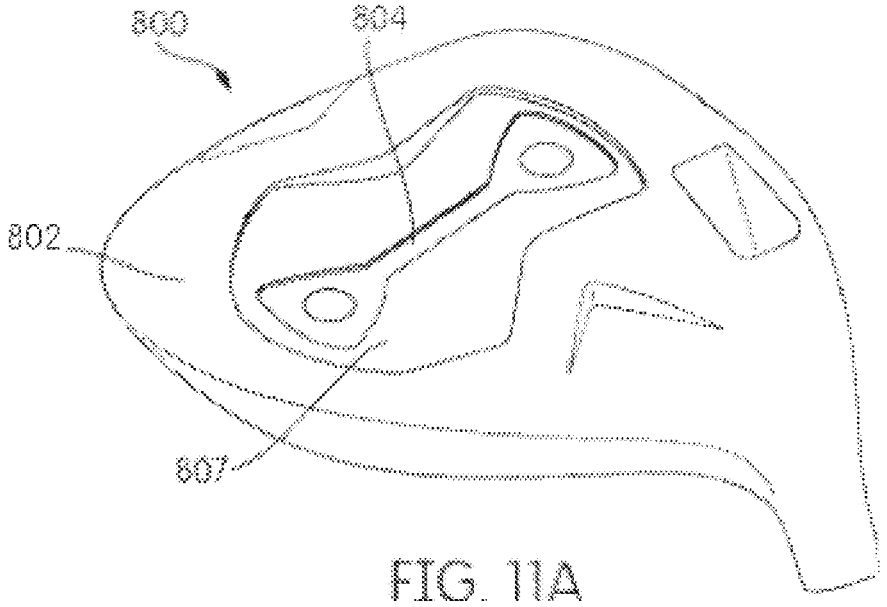
FIGS. 11A-11C illustrate a golf club head for use with an adjustable weighted member but with the adjustable weighted member removed according to one or more aspects described herein.
Figure 11B:
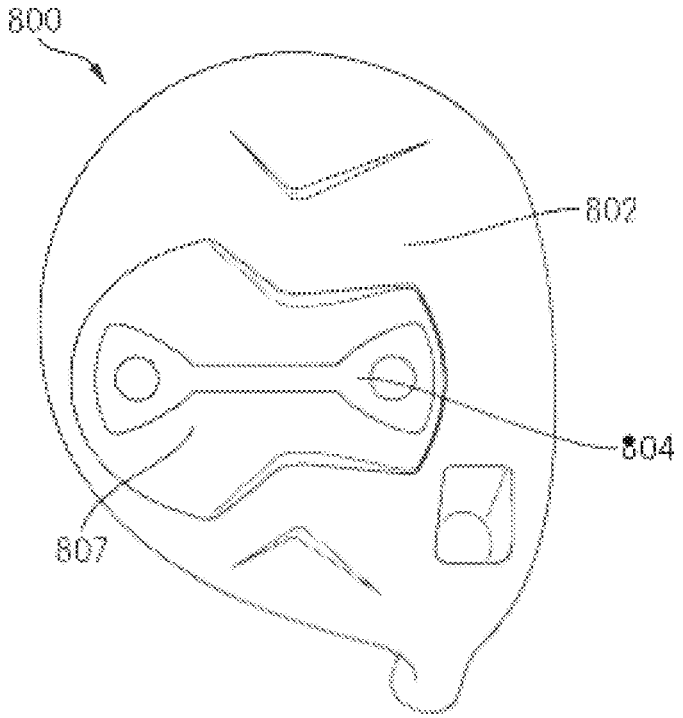
Figure 11C:
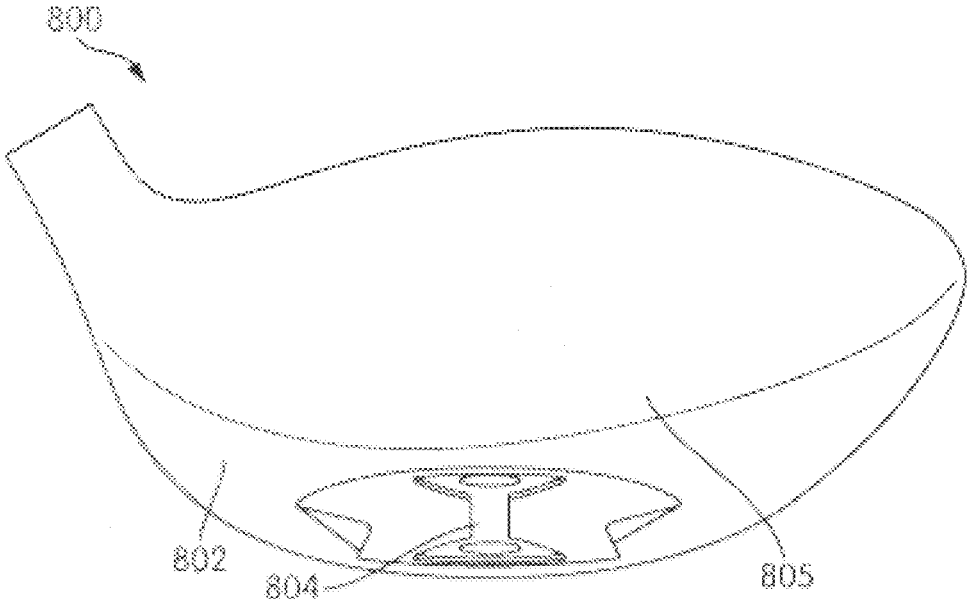

FIGS. 11A-11C illustrate a golf club head 800 configured to receive a weighted member but with the weighted member, fasteners, etc. removed. The golf club head 800 includes a recess 804 formed in the sole 802 and configured to receive the weighted member. Similar to the arrangements described above, the recess 804 may be generally shaped to correspond to the shape of the weighted member. The golf club head 800 may include a further recessed area 807 which may be provided to protect the weighted member from damage, wear, etc. during use. That is, in some examples, the weighted member may be positioned below the sole 802 of the golf club and may make minimal or no contact with the ground during use.

Similar to the arrangements discussed above, the weighted member may have two ends, each having different weighting characteristics. A user may determine one or more desired performance characteristics for the golf club head 800 and may position the weighted member in the recess 804 to provide the desired performance characteristics.

As shown in FIG. 11C, the recess 804 for receiving the weighted member may be visible from a rear 805 of the golf club head 800 and may be positioned to minimize contact with the ground during use.

Figure 12A:
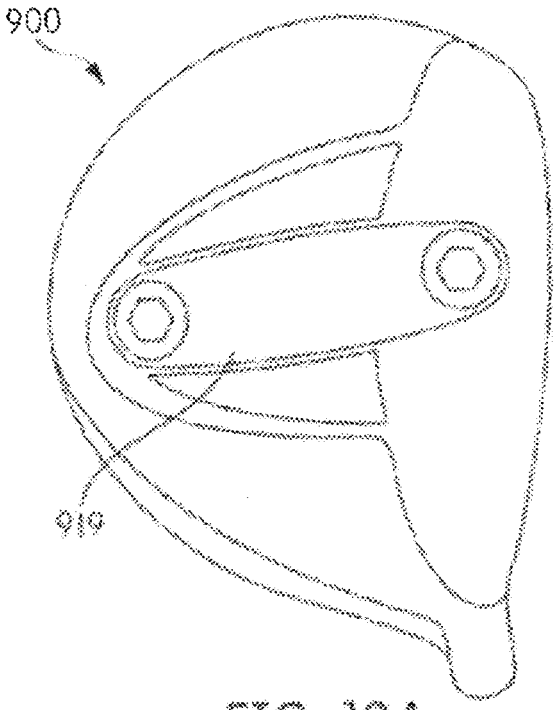
FIGS. 12A-12D illustrate alternate golf club head and adjustable weighted member arrangements according to one or more aspects described herein.

FIGS. 12A-12D illustrate various alternate arrangements of golf club heads and weighted members according to one or more aspects described herein. FIG. 12A illustrates a golf club head 900 having a weighted member 919. The weighted member 919 may be connected to the golf club head 900 at two points, similar to some arrangements described above. The weighted member 919 may be substantially oval in shape. Similar to the arrangements discussed above, one end of the weighted member 919 may have different weight characteristics than another end of the weighted member, thus providing customizable performance characteristics of the golf club head 900 based on a position of the weighted member 919.

Figure 12B:
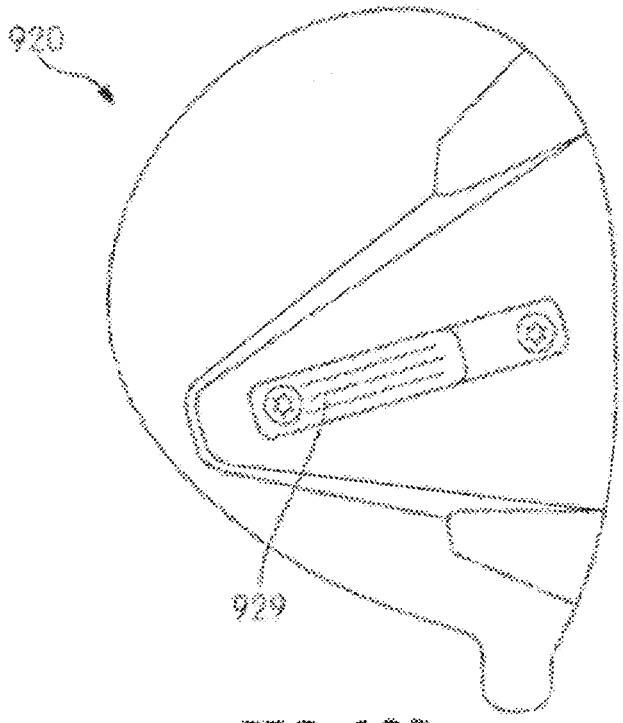

FIG. 12B illustrates another golf club head 920 having a weighted member 929. The weighted member 929 may be substantially rectangular and may be connected to the golf club head at two points. Further, as shown in FIG. 12B, the appearance of each end of the weighted member 929 may be different, to indicate a different in weight or performance characteristics associated with each end of the weighted member 929. The difference in appearance may be the result of different materials being used to form the weighted member or may be provided during manufacture to provide a visual indication of the different characteristics of the ends of the weighted member 929.

Figure 12C:
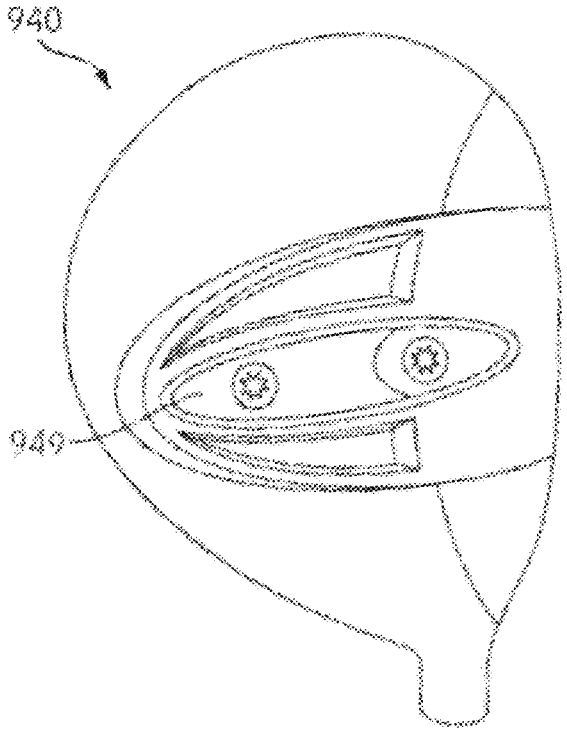

FIG. 12C illustrates yet another golf club head 940 having a weighted member 949. The weighted member 949 may be substantially oval, similar to the arrangement of FIG. 12A. However, the appearance of the ends of the weighted member 949 may be different. As discussed above, the difference in appearance may be due to different materials used to form the ends or may be provided during manufacturing to provide a visual indicate of the different weight characteristics of each end. The weighted member 949 is connected to the golf club head 940 at two points and may be removed from the golf club head and repositioned (e.g, the weighted member 949 may be turned or "flipped" to put a first end in the previous position of a second end and vice versa) to adjust the performance characteristics of the golf club head 940.

Figure 12D:
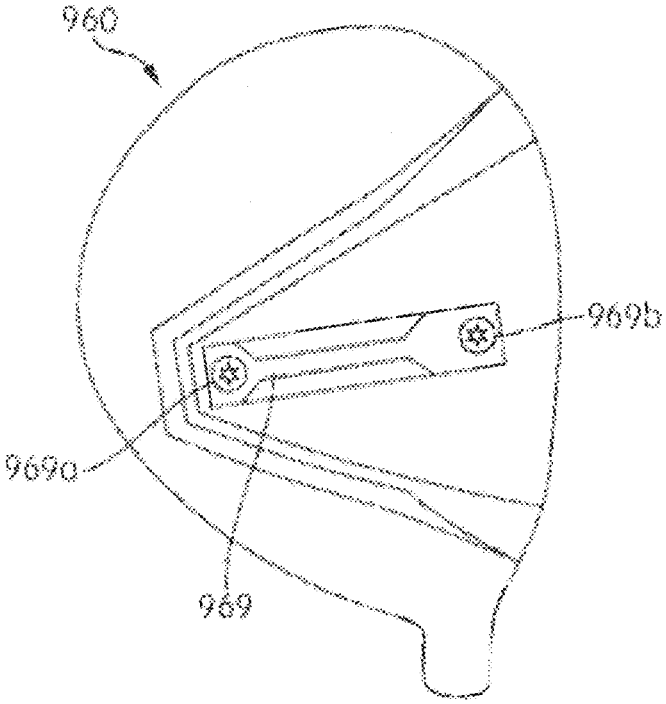

FIG. 12D illustrates yet another golf club head 960 having a weighted member 969. The weighted member 969 may have a shape similar to other weighted members discussed above and may be connected to the golf club head 960 at two points. The ends of the weighted member 969 may have different weighting characteristics adjustment of the position of the weighted member 969 within the golf club head 960 may adjust one or more performance characteristics of the golf club head 960.

As shown in FIG. 12D, one end 969*b* may be differently shaped form another end 969*a*. For instance, end 969*b* may be longer than end 969*a*, thus resulting in more material causing end 969*b* to be heavier or have more weight associated with it than end 969*a*. In this arrangement, the recess into which the weighted member 969 is received may be rectangular in order to accommodate any position of the weighted member 969.

Referring still to FIGS. 12A-12D, the respective club head recesses and weight members may have alternate positions. In certain exemplary embodiments, the recess and weight member may have a skewed or angled position. The recess and weight member may be angled with respect to a longitudinal axis that is generally transverse to the ball striking face of the club head. As illustrated in FIGS. 12A-12D, the recess can comprise a longitudinal axis that is angled toward the heel in in front to rear direction (or angled towards the toe end in a rear to front direction). The weight, likewise, is also angled toward the heel when received by the angled recess (or angled towards the toe end in a rear to front direction). Such an angled position provides further customization of the weighting characteristics of the golf club head.

Figure 13:
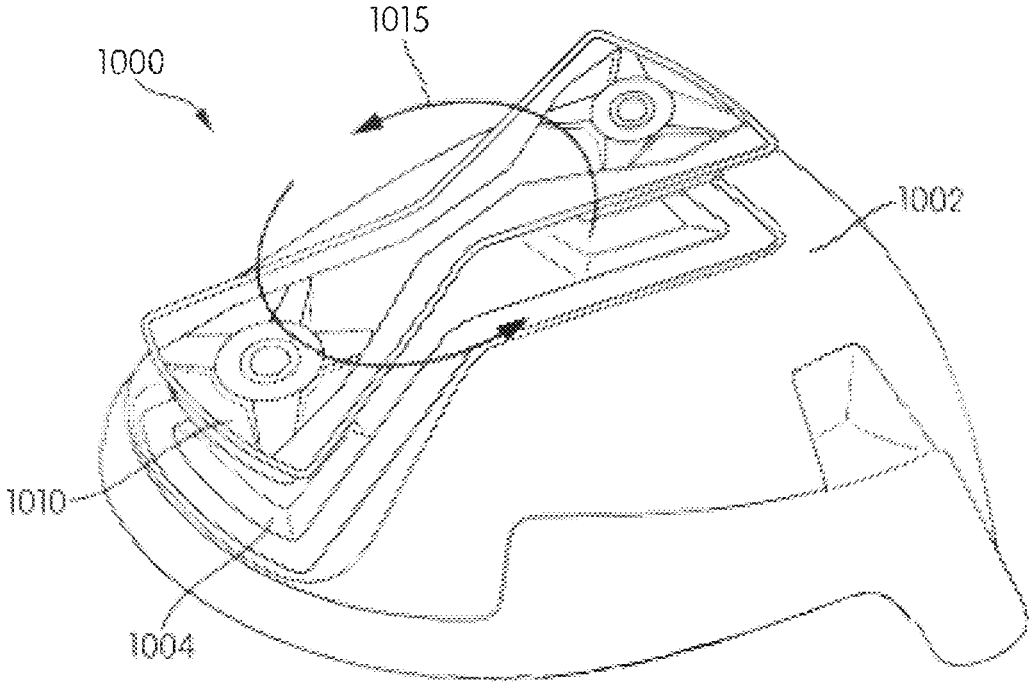
FIG. 13 is another golf club head arrangement having an adjustable weighted member shown removed from the golf club head and having arrows indicating rotation of the adjustable weighted member according to one or more aspects described herein.

FIG. 13 illustrates another golf club head 1000 having an adjustable weighted member 1010. The weighted member 1010 in FIG. 13 is shown removed from the golf club head 1000 and, in particular, from the recess 1004 formed in the sole 1002 of the golf club head 1000. Arrows 1015 indicate that the weighted member 1010 may be rotated and replaced in the recess 1004 in an alternate configuration to adjust the performance characteristics of the golf club head 1000, similar to arrangements described above.

Figure 14:
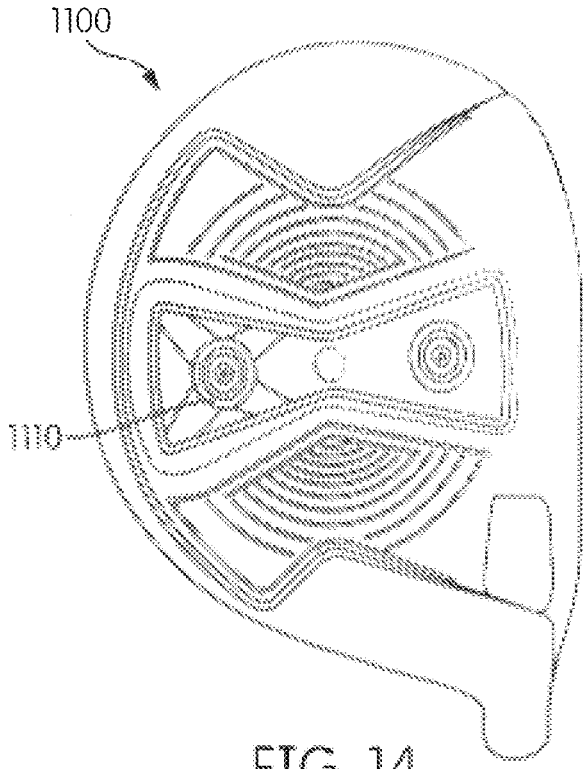
FIG. 14 is yet another golf club head arrangement having an adjustable weighted member according to one or more aspects described herein.

FIG. 14 illustrates another example golf club head 1100 having an adjustable weight member 1110. The adjustable weight member 1110 may have two ends, each having different weighting characteristics. The ends of the weighted member 1110 may have different appearances, to provide a visual indication of the different weight characteristics of each end.

The shape of the weighted member 1110 may be symmetrical in order to be received in the golf club head in any suitable arrangement. However, the appearance of one end of the weighted member 1110 extends over more than half of the weighted member 1110 to provide a somewhat asymmetrical appearance. The difference in appearance may indicate that the end having the appearance extending over more than half of the weighted member 1110 may be a heavier end.

Figure 15:
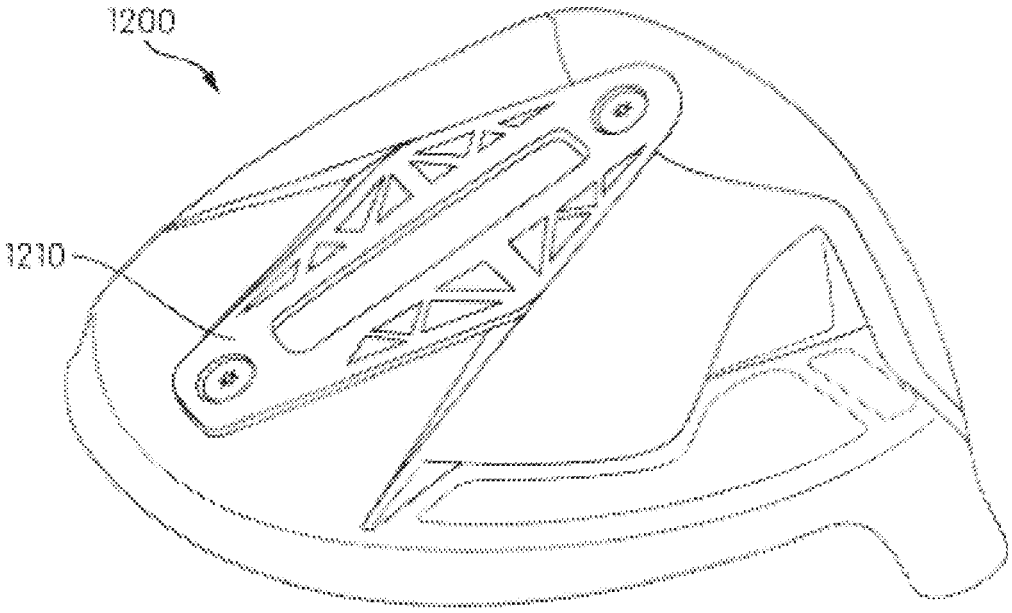
FIG. 15 is yet another golf club head arrangement having an adjustable weighted member according to one or more aspects described herein.

FIG. 15 illustrates yet another golf club head 1200 having an adjustable weighted member 1210. The weighted member 1210 is positioned in the sole of the golf club head 1200 and may be removed and repositioned to adjust one or more performance characteristics of the golf club head 1200.

The shape of the weighted member may be varied as shown in the various figures. For example, the ends of the weighted member may be square, rectangular, circular, elliptical, or triangular, to provide two different weight regions in the single weighted member. As discussed, the weighted member may have a streamlined central portion or central portion having a reduced lateral dimension wherein weight can be more focused at distal ends of the weighted member.

Any suitable means may be used to connect the weighted member to the golf club head may be used such as screws and bolts. Protrusions may be present to guide the weighted member into position and also provide some weight characteristics. U.S. Pat. No. 7,153,220 discloses examples of protrusions which is incorporated by reference in its entirety.

Although several arrangements described herein generally include a weighted member extending in a front to rear direction, in some examples, the weighted member may extend in a toe to heel direction to allow for adjustment of weight distribution from the toe to the heel or heel to the toe. Various other positions of the weighted member may be used without departing from the invention.

Further, the weighted member may be formed using one or more known methods of manufacture, including various molding processes, casting, machining and the like. Further, some arrangements may include post manufacture processing steps, such as coating, painting, etc. to finish the weighted member.

The adjustable weighted member may be made of any suitable material, including metals, non-metallic materials, composites, ceramics, polymers, and the like. In some arrangements, the adjustable weighted member may be formed of carbon steel, stainless steel, carbon fiber, tungsten, tungsten loaded polymer, combinations of one or more of these materials, and the like. In some arrangements, the adjustable weighted material may be formed of a flexible material to allow some bending or flex in the adjustable weighted member. In other arrangements, the adjustable weighted member may be formed of stiffer materials. In order to provide the first end and second end with different weight characteristics, the first end and second end may be made of the same material but formed to have different densities or thicknesses, for example, or the first end and second end may be formed of different materials. The weighted member may also be formed with materials utilizing suspended particles to provide desired weighting characteristics.

The adjustable weight member has many benefits. Adjusting the weight member from a first configuration to a second configuration may influence the energy and velocity transferred to the ball by the impact, as well as the moment of inertia and the center of gravity of the club head. The moment of inertia of the golf club head can also be affected by the different weighting configurations. In addition, the center of gravity of the club head can be affected by the different weighting configurations.

Additionally, different weighting configurations can further affect the performance characteristics of the golf club head. The following descriptions regarding the different weighting configurations make certain assumptions such as identical club head speeds, impact location and golf ball used. In a first weighting configuration, the weight member is positioned such that the heavier weight is positioned towards the rear of the club head. Thus, the center of gravity of the golf club head is more towards the rear of the golf club head. With the heavier weight more towards the rear of the club, as a golfer swings the golf club, the golf club shaft bows more wherein right before ball impact, the club head face has a more lofted position and the face angle is more closed. Upon ball impact, a higher launch angle is provided and having more ball spin and more loft. The golf ball trajectory will have a greater tendency to be towards the left for a right-handed golfer. In a second weighting configuration, the weight member is positioned such that the heavier weight is positioned towards the front of the club head. Thus, the center of gravity of the golf club head is more towards the front of the golf club head. With the heavier weight more towards the front of the club, as a golfer swings the golf club, the golf club shaft bows less than in the first weight configuration and wherein right before ball impact, the club head face has a less lofted position and the face angle is less closed. Upon ball impact, a lower launch angle is provided and having less ball spin and less loft. The golf ball trajectory will have a greater tendency to be towards the right for a right-handed golfer. Thus, a ball spin differential is achieved by positioning the weight member in the different weighting configurations. More ball spin is achieved with the heavier weight located towards the rear of the club head, and less ball spin is achieved with the heavier weight located towards the front of the club head. With the present design, golfers have the ability to customize the golf club head to provide desired characteristics such as ball spin.

Further exemplary embodiments of the invention include golf club heads described herein and that also are capable of having adjustable parameters. For example, a golf club head may have adjustment mechanisms associated therewith allowing the adjustment of certain parameters such as adjustment of loft angle of the golf club head. The adjustment mechanisms may take various forms but generally are operably associated with the golf club head. In one exemplary embodiment, the adjustment mechanism may be a hosel-based mechanism such as shown in U.S. Pat. No. 8,182,357 and U.S. Patent Appln. Ser. Nos. 61/577,660 and 61/526,325, which patent and patent applications are incorporated herein by reference.

Such adjustment mechanisms may allow a golfer to adjust the loft angle of a driver type golf club to a higher loft setting such as but not limited to 11 degrees, 11.5 degrees, 12 degrees or 12.5 degrees. Having the adjustable weight member positioned with the heavier weight towards the rear of the club head provides a low center of gravity that is further back in the golf club head. Such a configuration further may provide beneficial launch conditions for such higher loft settings, and increased forgiveness resulting from a higher club head moments of inertia. Other golfers, oftentimes more skilled golfers, prefer a less lofted golf club head and would utilize the adjustment mechanism to provide a loft setting such as but not limited to 7.5 degrees, 8 degrees or 8.5 degrees and even 9 degrees. Such loft settings generally allow the golfer to hit more boring and less lofted golf shots. Such golfers also generally prefer the ability to control, or shape, their golf shots and such control may be hampered if the center of gravity is too far back towards the rear of the golf club head. With the adjustable weighted member of the present invention, the heavier end of the weighted member can be positioned towards the front of the golf club head. This provides a center of gravity that is more forward in the golf club head and lower club head moments of inertia. In such a position with a lower loft setting (e.g., 7.5-9 degrees), skilled golfers may benefit from enhanced shot shaping capabilities with the club head and improved launch conditions. Thus, the adjustable weighted member utilized in conjunction with other adjustment mechanisms provides further customization options to the golfer. It is understood that in addition to driver type golf clubs, such features are equally applicable to other golf clubs such as fairway woods, hybrids and the like.

It is understood that golfers having the ability to generate increased club head speed may select a stiffer shaft to obtain similar benefits as described herein regarding the different weighting configurations.

Accordingly, club head features that permit the weighting and weight distribution of the head to be adjusted or customized may provide improved performance in several ways including ball trajectory, ball speed, loft, distance, and spin. The adjustable weight feature can be used to customize the club head to produce desired characteristics for a particular golf ball being used.

Thus, while there have been shown, described, and pointed out fundamental novel features of various embodiments, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps which perform substantially the same function, in substantially the same way, to achieve the same results are within the scope of the invention. Substitutions of elements from one described embodiment to another are also fully intended and contemplated. It is the intention, therefore, to be limited only as indicated by the scope of the claims appended hereto.

What is claimed is:

1. A golf club head, comprising:

a golf club head body having a front, a rear, a crown, a sole, a toe, a heel; and a recess formed in the sole, wherein the sole is angled such that it forms an upward incline in a front to rear direction;

wherein the front comprises a striking surface;

the recess forming a recess surface on the sole, wherein the recess surface is depressed from the sole toward the crown of the golf club head body, the recess extending in a front to rear direction along the sole of the golf club head body;

wherein the recess comprises a major longitudinal axis extending generally in a front to rear direction;

wherein the recess comprises of a first end and a second end;

wherein the major longitudinal axis is skewed, such that the recess is angled with respect to a striking surface longitudinal axis that is generally transverse to the striking surface;

wherein the recess further comprises a first notch located at the first end and a second notch located at the second end;

an adjustable weight member configured to be received entirely in the recess, such that no portion of the adjustable weight member extends beyond a perimeter of the recess, the adjustable weight member consisting of a first end and a second end, wherein the first end and the second end of the weight member define an oval shape, wherein the adjustable weight member extends from the first end of the recess to the second end of the recess when received in the recess, wherein the adjustable weight member is also angled with respect to the striking surface longitudinal axis, wherein the first end of the adjustable weight member having a visual appearance different than the second end of the adjustable weight member, wherein the adjustable weight member consists of two configurations:

an initial configuration in which the first end of the adjustable weight member is adjacent the first end of the recess, and a flipped configuration in which the first end of the adjustable weight member is adjacent the second end of the recess;

wherein the first end of the recess has a first bottom surface having a first aperture and the second end of the recess has a second bottom surface having a second aperture, wherein the adjustable weight member comprises a first material and a second material, wherein either the first end of the adjustable weight member or the second end of the adjustable weight member is comprised of the first material and the other of the first end and the second end is comprised of the second material, and wherein the first material has a higher density than the second material.

2. The golf club head of claim 1, wherein, the first end of the recess comprises a first width and the second end comprises a second width.

3. The golf club head of claim 1, wherein each of the first aperture and the second aperture include threads and are configured to receive a threaded fastener.

4. The golf club head of claim 2, wherein the first width and the second width of the recess are connected by a center portion having a third width.

5. The golf club head of claim 1, wherein the major longitudinal axis of the recess is angled toward the heel in the front to rear direction relative to the striking surface longitudinal axis.

6. The golf club head of claim 1, wherein the weight member comprises a top surface and a bottom surface, wherein the bottom surface is oriented toward the crown of the golf club head with the adjustable weight member is received in the recess, wherein when the adjustable weight member is received in the recess, the top surface of the adjustable weight member is offset towards the crown of the golf club head via the first notch and the second notch in reference to a surface of the sole surrounding the recess, such that the adjustable weight member makes minimal or no contact with the ground during use.

7. A golf club head, comprising:

a golf club head body having a front, a rear, a crown, a sole, a toe, a heel; and a recess formed in the sole, wherein the sole is angled such that it forms an upward incline in a front to rear direction;

wherein the front comprises a striking surface;

the recess forming a recess surface on the sole, wherein the recess surface is depressed from the sole toward the crown of the golf club head body, the recess extending in a front to rear direction along the sole of the golf club head body;

wherein the recess comprises a major longitudinal axis extending generally in a front to rear direction;

wherein the recess comprises of a first end and a second end;

wherein the major longitudinal axis is skewed, such that the recess is angled with respect to a striking surface longitudinal axis that is generally transverse to the striking surface;

wherein the major longitudinal axis of the recess is angled toward the heel in the front to rear direction;

wherein the recess further comprises a first notch located at the first end and a second notch located at the second end;

and an adjustable weight member configured to be received entirely in the recess, such that no portion of the adjustable weight member extends beyond a perimeter of the recess, the adjustable weight member consisting of a first end and a second end, wherein the first end and the second end of the weight member define an oval shape, wherein the adjustable weight member extends from the first end of the recess to the second end of the recess when received in the recess, wherein the adjustable weight member is also angled with respect to the striking surface longitudinal axis, wherein the adjustable weight member comprises a first fastener at the first end and a second fastener at the second end;

wherein the first fastener and the second fastener comprise different weights;

wherein the adjustable weight member consists of two configurations:

an initial configuration in which the first end of the adjustable weight member is adjacent the first end of the recess, and a flipped configuration in which the first end of the adjustable weight member is adjacent the second end of the recess;

wherein the adjustable weight member comprises a first material and a second material, wherein either the first end of the adjustable weight member of the second end of the adjustable weight member is comprised of the first material and the other of the first end and the second end is comprised of the second material, and wherein the first material has a higher density than the second material.

8. The golf club head of claim 7, wherein the first fastener and the second fastener are threaded and configured to removably attach the adjustable weight member to the golf club head body.

9. The golf club head of claim 7, wherein the weight member comprises a top surface and a bottom surface, wherein the bottom surface is oriented toward the crown of the golf club head with the adjustable weight member is received in the recess, wherein when the adjustable weight member is received in the recess, the top surface of the adjustable weight member is offset towards the crown of the golf club head via the first notch and the second notch in reference to a surface of the sole surrounding the recess, such that the adjustable weight member makes minimal or no contact with the ground during use.

* * * * *